United States Patent [19]

Brauner et al.

[11] 4,220,416

[45] Sep. 2, 1980

[54] APPARATUS FOR THE CONTINUOUS STATIC MIXING OF FLOWABLE SUBSTANCES

[75] Inventors: Dieter Brauner, Solingen-wald; Günter Imhäuser; Hans Kaluza, both of Cologne; Edgar Muschelknautz, Leverkusen, all of Fed. Rep. of Germany

[73] Assignee: Bayer Aktiengesellshaft, Leverkusen, Fed. Rep. of Germany

[21] Appl. No.: 679,113

[22] Filed: Apr. 22, 1976

[30] Foreign Application Priority Data

May 17, 1975 [DE] Fed. Rep. of Germany ..... 2522106

[51] Int. Cl.[2] ..... B01F 5/06

[52] U.S. Cl. ..... 366/337; 366/340

[58] Field of Search ..... 259/4 AB, 4 AC, 4 A; 138/38, 42; 366/336, 337, 338, 339, 340, 341

[56] References Cited

U.S. PATENT DOCUMENTS

| | | | |
|---|---|---|---|
| 3,090,603 | 5/1963 | Johnson | 366/144 |
| 3,285,580 | 11/1966 | Renaudette | 366/160 |
| 3,682,443 | 8/1972 | Upmeier | 259/4 AB |
| 3,923,288 | 12/1975 | King | 259/4 AB |

*Primary Examiner*—Robert W. Jenkins

*Attorney, Agent, or Firm*—Sprung, Felfe, Horn, Lynch & Kramer

[57] ABSTRACT

In an apparatus for the continuous static mixing of flowable substances in a tubular housing with mixing inserts, the peripheral flow in the housing and the ease of manufacture of the mixing inserts are improved by having the mixing inserts composed of planes provided with intersecting throughflow slots and webs, in which the webs of both planes form a single piece with a transversely extending connecting web and the throughflow slots extend to the housing wall.

11 Claims, 11 Drawing Figures

APPARATUS FOR THE CONTINUOUS STATIC MIXING OF FLOWABLE SUBSTANCES

The present invention relates to an apparatus for the continuous static mixing of flowable substances, comprising a tubular housing with at least one mixing insert arranged within it, consisting of webs arranged in two intersecting planes running diagonally with respect to the housing wall, and with a throughflow slot being located between each of the two webs.

Devices for static mixing, e.g. for homogenisation, heat exchange or for inducing reactions, are becoming increasingly used, in particular when it is desired to put in mixing or reaction stages at specific points in continuous processes. A particular advantage is that static mixing devices have no rotating parts and as a consequence present no difficulties in respect of sealing bearings and shafts.

A known apparatus of this type consists for example of a tubular housing in which blade-like curved inserts are arranged, which alternately deflect the flowing products to the right and left. The blade-like inserts are arranged at an angle to one another. Thus the incoming product is divided by each insert into new partial flows, so that a very good mixing effect is achieved with the minimum pressure loss. However the disadvantage of this apparatus is its great length.

For this reason devices have already been developed of which the length is only a fifth or tenth of that of the above mentioned apparatus. These compact devices however have a very high pressure loss. Their use is not subject to technical limits in respect of construction, so that they can be used to achieve more compact installations. In relation to their length, these compact mixing devices have a much higher mixing effect than the long mixing devices.

A compact mixing apparatus of this type consists for example of interpenetrating comb-like pairs of plates, so that in the tube a system of intersecting elements arranged diagonally to the direction of flow is formed. This embodiment provides good homogenisation with a short length and not excessively high pressure loss. With many mixing problems, in particular when reactive components are involved or when there is a possibility of sedimentation, the webs connections contacting the tube wall can have a disruptive effect. In this case the individual mixing units are composed of two individual elements in the form of comb-like plates.

It is the object of the present invention to provide an apparatus for continuous static mixing having a short length and low pressure loss, which also gives a good homogenisation effect in the peripheral zones, i.e. at the tube wall.

According to the invention, there is provided an apparatus for the continuous static mixing of flowable substances, comprising a tubular housing having at least one mixing insert arranged therein, the mixing insert comprising a plurality of webs arranged in a plurality of intersecting planes at an acute angle to the housing wall, a slot being located between adjacent webs in the same plane, the webs being arranged on a common connecting web extending transversely across the housing, and perpendicular to the longitudinal axes of the webs and the slots extending to the housing wall.

The effect of this is that the ends of the individual webs are free of transverse connections in the zone of the housing wall, so that an undisturbed flow is also achieved in this zone and no deposits can form.

The individual mixing units can very advantageously be produced by the injection moulding process or by the stamping method. In the case of apparatus having a large housing diameter, the prefabrication of the webs and their welding with the connecting web may be profitable. Manufacture by stamping is particularly favourable because the webs merely need to be separated from one another from a preformed sheet and angled alternately to the right and left. This automatically produces the throughflow slots without loss of material. The mounting of such a mixing unit in the housing may be effected by shrinking of the housing or clamping, but preferably by welding or soldering. It is also possible to screw or rivet them to the housing wall.

The two planes in which the webs are arranged preferably enclose an angle of 90° and thus form an angle of 45° with the housing wall. Variations in the flow can be effected by selecting other angles for example between 30° and 60° with the housing wall. The connecting web should preferably run vertically through the centre axis of the housing. But an eccentric arrangement is also possible, for example in order to influence the velocity of flow over the cross-section of the housing. The webs themselves should have the same width, but they can also be of varying widths or conical. Twisted webs also produce particular mixing effects.

In the arrangement of several mixing inserts one after another the connecting webs are preferably also designed as distancing pieces. For this purpose either the connecting web is correspondingly wide or it is provided with spigots which engage in optionally present clamping sockets or clamping holes in the connecting web of the mixing insert arranged before it. The selection of a specific distance between two mixing inserts can have an influence on the pressure loss and the mixing effect as a function of the viscosity and the velocity of flow of the substances to be mixed.

According to a particular embodiment of the apparatus according to the invention, two mixing inserts are arranged mirror symmetrically with the connecting webs pointing to one another. Preferably, by means of a single common connecting web the two mixing inserts should form a single piece. This embodiment resembling in shape "Spanish riders" has, in particular in the case of common connecting webs, the advantage of easy manufacture and high stability.

As in the known static mixing devices, preferably a plurality of mixing inserts are arranged one after another, so that the mixing effect is increased.

According to a particular embodiment, a plurality of mixing inserts are arranged with their webs and throughflow slot interpenetrating. The effect of this is to keep the length of the mixing apparatus short.

According to a further particular embodiment, the invention provides that a plurality of mixing inserts are arranged one after another in sets. According to the arrangement possibilities described of individual mixing inserts the sets can be arranged at an angle to one another and/or directed against one another. The constructor has at his disposal a variety of possibilities for the arrangement of mixing inserts and/or sets thereof. The possibilities are increased, the more mixing inserts and/or sets are used.

Whereas the production of sets of mixing inserts of larger diameter presents no difficulties, when considered relatively, the production of sets of small diameter becomes considerable more expensive below 100 mm, and particularly below 20 mm diameter, on account of the tolerances to be maintained.

In order to manufacture rationally, therefore, in the context of the present invention the individual mixing inserts are produced oversize, formed into sets, preferably connected to one another, and these sets are cast with an auxiliary material, e.g., a low melting point metal or a plastic or soluble plastic, these sets are clamped on a lathe and turned to the internal diameter of the housing into which they are to be inserted. In this way the set is stabilised for turning. The auxiliary material can be melted out or dissolved before or after the insertion of the set into the housing. At low diameters, the individual mixing inserts could only be manufactured as precisely as with the production method according to the invention with great effort.

Various embodiments of the apparatus according to the invention are shown in the drawings and further described below.

Figure 1:
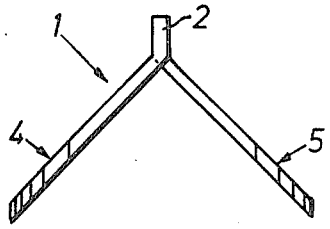
FIG. 1 shows a first embodiment of the mixing insert in a side view.
Figure 2:
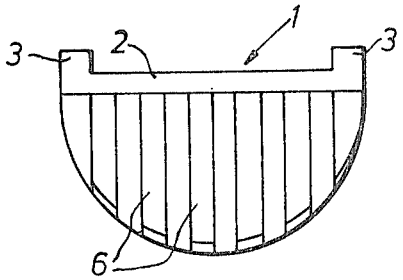
FIG. 2 shows the mixing insert shown in FIG. 1 in a side view, rotated through 90°.
Figure 3:
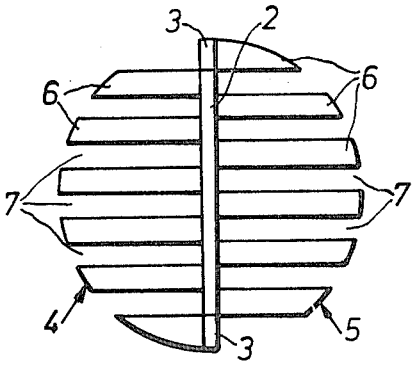
FIG. 3 shows a plan view of the same mixing insert.
Figure 4:
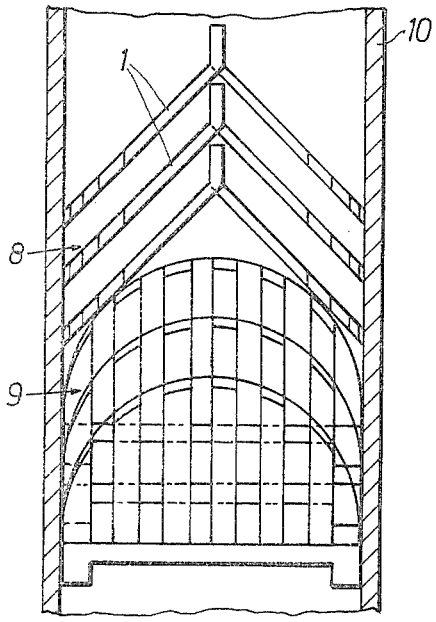
FIG. 4 shows the arrangement of mixing inserts according to FIGS. 1 to 3 in sets, in a tubular housing.

In FIGS. 1 to 3, the mixing insert 1 consists of a connecting web 2 with distancing pieces 3, on which in two planes 4, 5, webs 6 are arranged with throughflow slots 7 provided between them. The mixing insert 1 is produced from a semi-elliptically cut piece of plate, which has been placed under a stamp, to separate the individual webs frome one another by longitudinal cuts. Relative to the remaining connecting web 2, at the same time or subsequently, the adjacent webs were each angled to the right or left at 45°, so that they lie in two planes, at an angle of 90° with respect to one another. As shown in FIG. 4, several of such mixing inserts 1 are arranged in sets 8, 9 in a tubular housing 10 of circular cross-section, with the set 9 being angled at 90° to the set 8 and at the same time being arranged in the opposite direction in the direction of flow.

Figure 5:
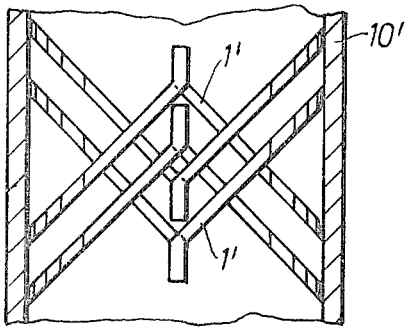
FIG. 5 shows a different arrangement of the mixing inserts in the housing.

In the embodiment shown in FIG. 5, in each case two mixing inserts 1' are arranged in a housing 10' facing opposite directions and with their webs interpenetrating.

Figure 6:
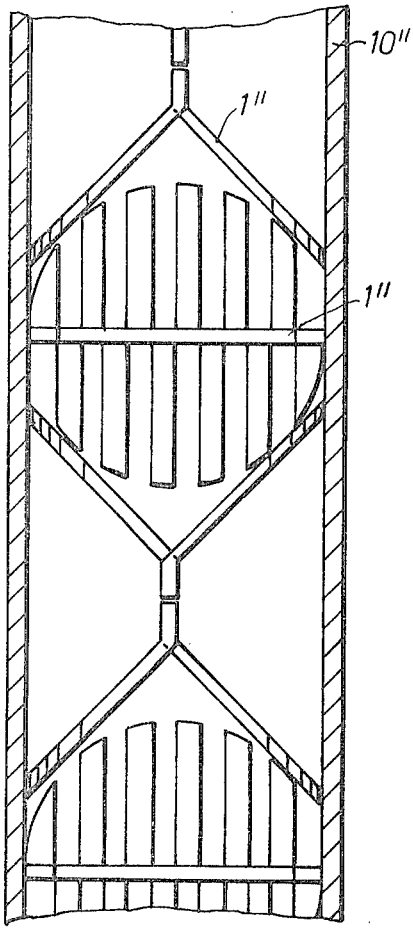
FIG. 6 shows a further variant of the arrangement of mixing inserts in the housing.

FIG. 6 shows in a housing 10'' a plurality of mixing inserts 1'', which are arranged at an angle of 90° to one another or facing opposite directions.

Figure 7:
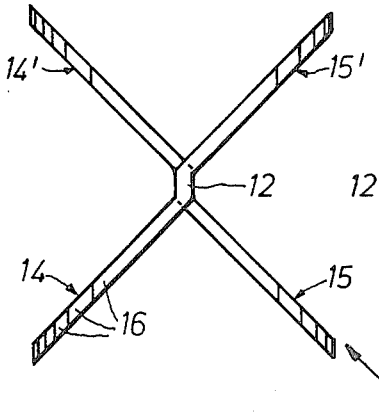
FIG. 7 shows a side view of a further embodiment of the mixing insert.
Figure 8:
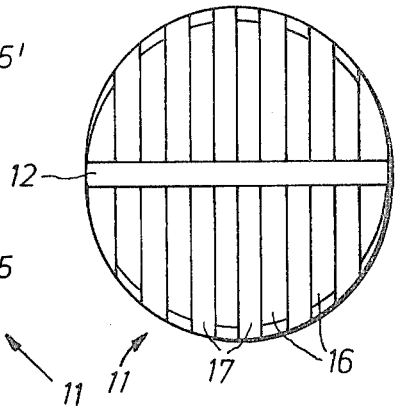
FIG. 8 shows the mixing insert shown in FIG. 7 in side view, rotated about 90°.
Figure 9:
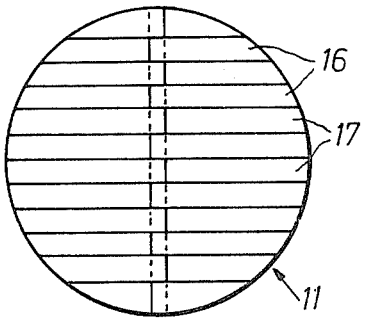
FIG. 9 shows a plan view of the same mixing insert.

The mixing insert 11 shown in FIG. 7 to 9 shows in principle two mixing inserts according to FIGS. 1 to 3 arranged facing opposite one another and joined by a common connecting element 12. On the connecting element 12 in four planes 14, 14'; 15, 15', there are arranged the webs 16, between which in each case there are located throughflow slots 17. Production is from an elliptical plate section in the manner described for FIGS. 1 to 3. The planes 14, 14' and 15, 15' are parallel, since in each case they run from the front to the rear edge of connecting element 12 in opposite directions.

Figure 10:
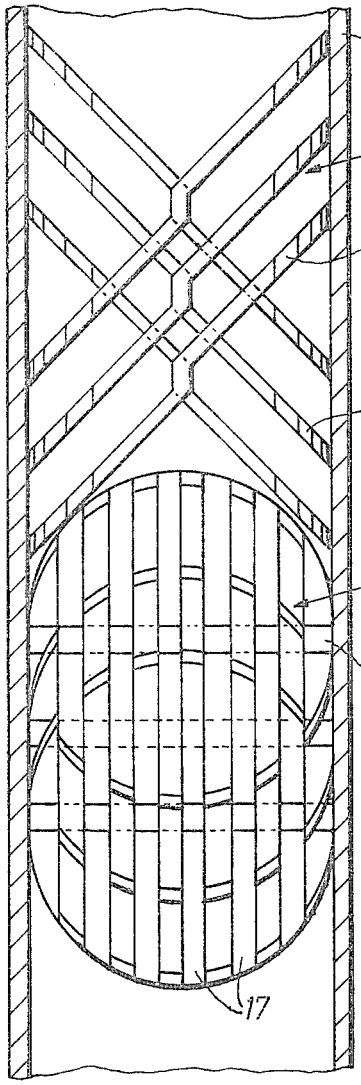
FIG. 10 shows the arrangement of mixing inserts according to FIG. 7 to 9 in sets in a tubular housing.
Figure 11:
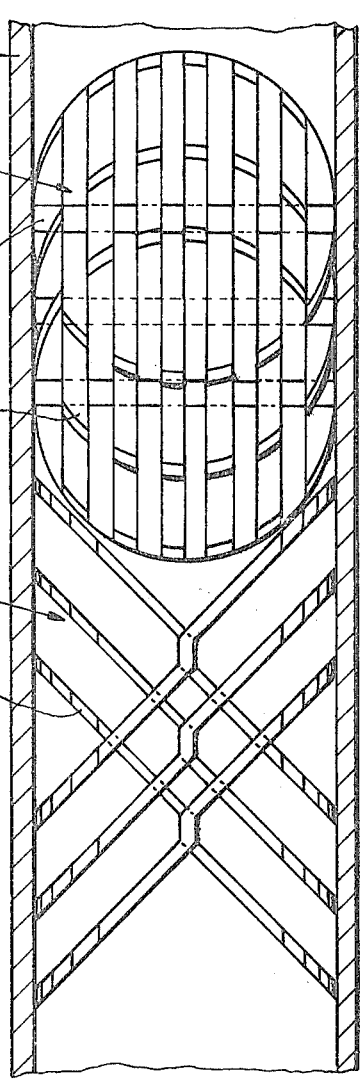
FIG. 11 shows the arrangement shown in FIG. 10, rotated through 90°.

In FIGS. 10 and 11, mixing inserts 12 as shown in FIGS. 7 to 9 are arranged as sets 18, 19 in a housing 20, and the individual mixing units 12 of each set 18, 19 interpenetrate with their webs 16 and throughflow slots 17.

EXAMPLE 1

A product having a viscosity of 12 Poise and a density of 1.0 g/cm$^3$ is to be mixed with 3% by weight of a low viscosity additive of 0.1 Poise at a throughput of 175 kg/h. It is required that the standard deviation of measurement samples whose volume in each case is 2.0 mm$^3$ and which are removed downstream of the mixer, should not exceed 1%. The maximum permissible pressure loss is rated at 3 bars.

The following mixing apparatus was selected corresponding to the embodiment according to FIGS. 10 and 11: internal diameter of housing 30 mm; width of webs and throughflow slots in each case 2 mm. The angle of the webs relative to the housing wall was 45°.

Nine sets each with seven mixing inserts were used: the sets were each angled at 90° to one another. The length of the mixing apparatus was 540 mm. A pressure loss of approximately 1.3 bars was measured.

EXAMPLE 2

The length of the mixing apparatus can be reduced still more in the event of a specific mixing task. If it is desired for example to homogenise a plastics melt having a viscosity of 1100 Poise and a density of 1.05 g/cm$^3$ at a temperature of 250° C. and a throughput of 48 kg/h in respect of residence time and temperature distribution, then the degree of mixing necessary corresponds to the admixture of approximately 10% by weight of an approximately equally viscous component.

The standard deviation of the measurement samples, whose volume in each case is 2.0 mm$^3$ may be approximately 5%. If a pressure loss of between 10 and 20 bars is acceptable, a mixing apparatus is suitable having mixing inserts according to FIGS. 7 to 9 with the following dimensions: internal housing diameter 30 mm, width of webs and throughflow slots in each case 2 mm. The angle between the housing wall and the cross pieces is 45°. Eight sets, each consisting of four mixing inserts, were used. The mixing length is 240 mm. A pressure loss of approximately 15 bars was measured.

What we claim is:

1. An apparatus for the continuous static mixing of flowable substances, comprising a tubular housing having at least one mixing insert arranged therein and receptive of an arriving stream of flowable substance to guide the stream parallel to the axis of the housing to and through the mixing inserts, each mixing insert comprising two planar portions disposed at an acute angle to the housing and intersecting and joined in a common connecting web extending transversely across the housing, wherein each of said planar portions extends over the cross-section of the housing limited only by the connecting web and the wall of the housing and each planar portion comprises a plurality of webs arranged in its corresponding plane and a slot located between adjacent webs in the same plane.

2. An apparatus according to claim 1, wherein two adjacent mixing inserts are arranged mirror symmetrically with the connecting webs pointing towards one another.

3. An apparatus according to claim 2, wherein the two mixing inserts form a single piece by means of a single common connecting web.

4. An apparatus according to claim 1, wherein a plurality of mixing inserts are arranged one after another along the axis of the housing.

5. An apparatus according to claim 4, wherein a plurality of mixing inserts are arranged so that the webs of one mixing insert pass through the slots in another.

6. An apparatus according to claim 4 wherein the mixing inserts are arranged at an angle to one another.

7. An apparatus according to claim 4, wherein a plurality of sets of mixing inserts are arranged one after another along the axis of the housing.

8. An apparatus according to claim 7, wherein the sets are arranged at an angle to one another.

9. An apparatus according to claim 8, wherein, in each set, the webs of one mixing insert pass through the slots in another.

10. An apparatus according to claim 7, wherein adjacent sets are arranged facing one another.

11. An apparatus according to claim 7, wherein, in each set, the webs of one mixing insert pass through the slots in another.

* * * * *